US008746769B2

(12) United States Patent
Owen

(10) Patent No.: US 8,746,769 B2
(45) Date of Patent: Jun. 10, 2014

(54) PORTABLE SKI AND SKI POLE CARRIER SYSTEM

(71) Applicant: David B. Owen, Stevenson Ranch, CA (US)

(72) Inventor: David B. Owen, Stevenson Ranch, CA (US)

( * ) Notice: Subject to any disclaimer, the term of this patent is extended or adjusted under 35 U.S.C. 154(b) by 0 days.

(21) Appl. No.: 14/042,400

(22) Filed: Sep. 30, 2013

(65) Prior Publication Data

US 2014/0028041 A1 Jan. 30, 2014

Related U.S. Application Data

(63) Continuation-in-part of application No. 13/044,253, filed on Mar. 9, 2011, now Pat. No. 8,616,600.

(60) Provisional application No. 61/314,710, filed on Mar. 17, 2010, provisional application No. 61/352,907, filed on Jun. 9, 2010.

(51) Int. Cl.
*A63C 11/02* (2006.01)

(52) U.S. Cl.
CPC ..... *A63C 11/025* (2013.01); *Y10S 224/917* (2013.01)
USPC ..... 294/154; 294/147; 294/150; 294/165; 224/917

(58) Field of Classification Search
CPC .. A63C 11/023; A63C 11/025; A63C 11/009; A45F 5/10; A45F 3/14; A45F 2005/104; A45F 2005/1013; Y10S 224/917; B65G 7/12
USPC ..... 294/15, 31.2, 139, 147, 149, 150, 153, 294/154, 156, 157, 165; 224/250, 917
See application file for complete search history.

(56) References Cited

U.S. PATENT DOCUMENTS

| | | | | |
|---|---|---|---|---|
| 946,850 | A | 1/1910 | Tabler | |
| 3,278,097 | A | 10/1966 | Duckworth | |
| 3,768,711 | A | 10/1973 | Wilkinson | |
| 4,114,838 | A * | 9/1978 | Knauf | 294/157 |
| 4,402,542 | A | 9/1983 | Kreutzer | |
| 4,483,380 | A | 11/1984 | Beran | |
| 4,553,779 | A | 11/1985 | Shortridge | |
| 4,705,281 | A | 11/1987 | Spinas | |
| 4,746,159 | A | 5/1988 | Webb et al. | |
| 4,852,931 | A | 8/1989 | Ferdi | |
| 4,856,689 | A * | 8/1989 | Shore | 224/218 |

(Continued)

FOREIGN PATENT DOCUMENTS

| | | | |
|---|---|---|---|
| DE | 42 18 850 | A1 | 12/1993 |
| FR | 2 637 193 | A1 | 6/1990 |

*Primary Examiner* — Dean Kramer
(74) *Attorney, Agent, or Firm* — Kelly & Kelley, LLP

(57) ABSTRACT

A portable ski and ski pole carrier system includes a pair of flexible straps, each having a strap receiver and a strap fastener disposed at opposite ends. The strap receivers are configured to receive the strap fasteners and secure a pair of skis and ski poles within the straps. A handle is attached perpendicularly to the pair of straps and parallel to the pair of skis and ski poles. The ski poles are disposed between a heel binding on one of the pair of skis and a brake lever handle extending from the other of the pair of skis. The loops formed by the straps may be disposed between toe and heel bindings on the pair of skis. The interior of the straps may include a non-slip material to help secure the pair of skis.

16 Claims, 8 Drawing Sheets

(56) References Cited

U.S. PATENT DOCUMENTS

| | | | | | |
|---|---|---|---|---|---|
| 4,867,359 | A | * | 9/1989 | Donovan | 224/602 |
| 4,911,347 | A | * | 3/1990 | Wilhite | 224/257 |
| 5,468,036 | A | | 11/1995 | Brown | |
| 5,566,870 | A | | 10/1996 | Mejeur | |
| 5,575,412 | A | * | 11/1996 | Arias | 224/257 |
| 5,603,545 | A | | 2/1997 | Benson et al. | |
| 5,611,588 | A | | 3/1997 | Mencel | |
| 5,762,242 | A | | 6/1998 | Yost | |
| 5,853,212 | A | | 12/1998 | Daniel | |
| 5,908,206 | A | * | 6/1999 | LoPresti, Jr. | 280/814 |
| 6,637,077 | B2 | | 10/2003 | Doty | |
| 2003/0111856 | A1 | | 6/2003 | Hewett | |
| 2004/0094586 | A1 | | 5/2004 | MacAllister | |
| 2006/0076378 | A1 | | 4/2006 | Hall | |
| 2007/0114255 | A1 | | 5/2007 | Spadaccini | |
| 2011/0226826 | A1 | | 9/2011 | Owen | |

* cited by examiner

PORTABLE SKI AND SKI POLE CARRIER SYSTEM

FIELD OF THE INVENTION

The present invention generally relates to skiing. More particularly, the present invention relates to a portable ski carrier for the easy transportation and securing of a pair of skis and poles.

BACKGROUND OF THE INVENTION

Skiing is a group of sports using skis as equipment for traveling over snow. Skis are used in conjunction with boots that connect to the ski with the use of a binding. Skiing can be grouped into two general categories. The older of the two disciplines, originated in Scandinavia and uses free-heel bindings that attach at the toes of the skier's boots but not at the heels. This type of skiing is generally referred to as Nordic skiing. Types of Nordic skiing include cross-country, ski jumping and Telemark. The second general type of skiing is called Alpine skiing. Alpine skiing (often called "downhill skiing"), originated in the European Alps, and is characterized by fixed-heel bindings that attach at both the toe and the heel of the skier's boot. Alpine skiing is primarily used when traveling down a slope, as gravity propels the skier forward. Whereas Nordic skiers can traverse across open terrain with ease due to the free-heel binding.

No matter the type of skiing, it has become a popular recreational sport participated by many all across the world. Skiing is most visible to the public during the Winter Olympic Games where it is a major sport. Due to its popularity, ski technology has drastically improved over the years. The materials of the skis are now sophisticated composites that can flex and bend while still being light and maneuverable. Bindings have improved that allow the skier to adjust personal settings according to individual preferences. While ski technology has improved there still remains an age old problem; carrying one's skis.

Carrying a pair of skis is not so easy. While graceful on the slopes, even expert skiers have trouble easily carrying a pair of skis. Skis are still substantially heavy and burdensome to control when not in use. Their long lengths make them awkward to manipulate. This problem is exacerbated because you almost always have to carry two skis at any one time. Not only is a skier carrying two skis, but usually two poles as well. Typically people will attempt to lock the skis such that their bottom surfaces are touching. A single hand can then grip the skis for carrying. Unfortunately, the skier is almost undoubtedly wearing a pair of ski gloves or mittens. This only complicates matters for attempting to retain a secure grip. Compound all of these problems with the fact that walking in ski boots is also very difficult. As the skier walks, it is hard to keep a steady and even pace such that the skis won't start to fall or be dislodged from one's grip. Also, the distance walked can be quite significant as one is rarely able to find a parking spot relatively close to a chair lift. It is not uncommon to walk a substantial distance just to get to the slopes.

Accordingly, there exists a need for a device that can easily allow a skier to carry two skis comfortably and easily. Also, there is a need for this device to be compact and easily storable within one's pocket, such that it can be carried while skiing. The present invention fulfills these needs and provides other related advantages.

SUMMARY OF THE INVENTION

An exemplary embodiment of a portable ski carrier includes at least one flexible strap comprising a first end and a second end. A strap receiver is disposed at one end of the strap and a strap fastener is disposed at the other end of the strap opposite the strap receiver. The strap receiver is configured to receive the strap fastener. Then the strap is able to secure a pair of skis within the strap. A handle is attached to the strap between the first and second ends. The handle is also disposed perpendicular to the pair of skis.

In another exemplary embodiment, a grip may be disposed about at least a portion of the handle. The grip may comprise a rubber or foam material. The grip may also be rotatably attached to the handle.

The strap and handle may be comprised of a fabric material. The strap fastener may comprise a hook-and-loop type fastener and the strap receiver may comprise a ring. In these exemplary embodiments, the handle may be disposed substantially parallel to the strap. Furthermore, the interior of the strap may include a non-slip material to help secure the pair of skis.

In a particularly exemplary embodiment, the present invention is directed to a portable ski and ski pole carrier system. The system includes a pair of non-elastic, flexible straps attached to a handle. The straps each have a first end and a second end. A strap receiver is disposed at the first end of each strap and a strap fastener is disposed at the second end of each strap. The strap receivers are configured so as to receive the strap fasteners and form each of the pair of straps into a loop, and a pair of skis and ski poles are secured within the loops. The handle is disposed substantially perpendicular to each of the pair of straps and aligned with the pair of skis and ski poles within the loops. A non-slip material is included on an interior surface of each of the pair of straps when formed into a loop and configured so as to be disposed against the pair of skis and ski poles. In the system, the pair of skis are disposed within the loops formed by each of the pair of straps. The ski poles are also disposed within the loops adjacent to the pair of skis such that a portion of each ski pole is disposed between a heel binding on one of the pair of skis and a break lever handle extending from the other of the pair of skis.

The handle is slidably coupled to the pair of flexible straps. The straps and the handle comprise a flexible fabric material. The handle includes a grip disposed about at least a portion of the handle, which grip may comprise a rubber or foam material. The grip may also be rotatably attached to the handle. The strap fasteners each comprise a hook-and-loop type fastener. The strap receivers each comprise a ring.

The pair of skis are disposed with abutting bottom surfaces so as to form a resilient gap between a portion of the bottom surfaces. The loops formed by each of the pair of flexible straps are both configured to partially close the resilient gap so as to create a pre-load between the loops and the pair of skis. The loops formed by each of the pair of flexible straps are both disposed between toe bindings and heel bindings on the pair of skis.

In a particularly preferred embodiment, the portable ski and ski pole carrier is configured to compactly fold for storage. In this embodiment, each of the pair of straps is formed into a loop. The loops are then rolled inwardly underneath the handle such that the loops are flipped upside down. The loop formed by one of the pair of straps is then nested within the loop formed by the other of the pair of straps. Then handle snuggly extends around the nested loops.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
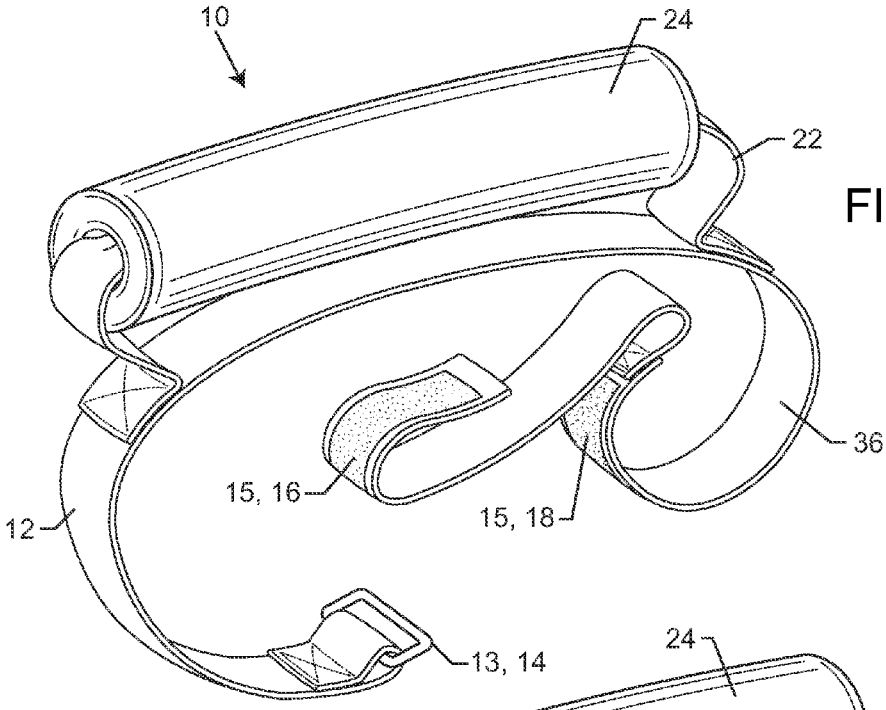
FIG. 1 is a perspective view of an exemplary embodiment of a ski carrier.

As shown in the drawings for purposes of illustration, the present invention for a ski carrier is referred to generally by the reference number 10. FIG. 1 is a perspective view of the ski carrier 10. The ski carrier 10 is comprised of a strap 12. The strap 12 is made from a sufficiently flexible yet sturdy material, typically a fabric. It is desirable that the fabric is water resistant and can be utilized within a wide temperature range. For instance, it is desirable that the strap 12 remain pliable at extremely low temperatures experienced on a ski slope and at the same time not melt or degrade if placed near a fireplace inside a cabin. The material of the strap 12 should also not creep significantly such that a tight attachment during the night doesn't loosen by the morning. Also, the strap 12 should be sufficient in length to secure at least a majority of the skis on the market. In other words, one size fits all.

The strap 12 has at one end a strap receiver 13. The strap receiver 13 may be comprised of a rectangular shaped ring 14. The ring 14 can be made from metal, plastic, or any other suitable material. The ring 14 can also be square shaped, oval shaped, or any other suitable shape and its design is not to be limited by the precise form described herein. The ring 14 is secured at the end of the strap 12 by sewing it permanently within. The ring 14 is appropriately sized such that the opposite end of the strap 12 can be fed therethrough.

Figure 2:
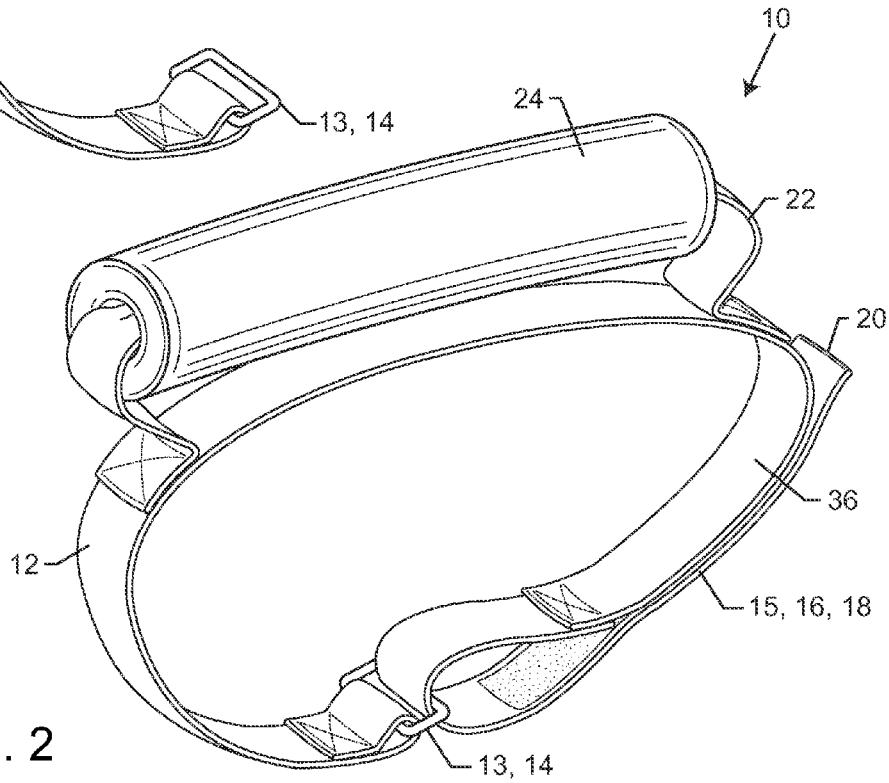
FIG. 2 is a perspective view similar to FIG. 1 wherein now the strap is fastened.

At the end opposite the ring 14 is a strap fastener 15. In this embodiment, the strap fastener 15 may be comprised of a typical hook-and-loop fastener. A hook-and-loop fastener has two sides; a hook side 16 and a loop side 18. The hooks from the hook side 16 grab the loops of material on the loop side 18, thereby securing it in place. This attachment technique is commonly referred to as the trademark Velcro, but is more generally described as a hook-and-loop fastener. As shown in FIG. 2, the strap 12 is fed through the ring 14 and pulled tight. Once pulled tight, the hook side 16 and loop side 18 are pressed together, thereby locking the hooks 16 and loops 18 together. To loosen the strap 12, the free end 20 is pulled perpendicularly with respect to the strap 12 such that the hooks 16 are dislodged from the loops 18. It is easily understood that the placement of the hook side 16 and loop side 18 may be switched, such that one is closer to the free end 20 as compared to the other. In this embodiment, the strap 12 is comprised of two sections sewn together. It is also to be understood to those skilled in the art that the strap 12 could be made from one continuous piece of material.

A handle 22 is sewn onto the strap 12. The handle 22 is permanently attached at each of its two handle ends to the strap 12 between the first and second ends of the strap 12. The handle 22 is also disposed perpendicular to a pair of skis 26. The handle 22 may be disposed substantially parallel to the strap 12.

The handle 22 is encased with a grip 24. The grip 24 can be made from any suitable foam, rubber, or other material or composite that helps to evenly spread the weight loads from carrying the pair of skis 26. The handle 22 and grip 24 create a structure that a skier can easily hold, while the strap 12 secures the skis 26 together.

In another exemplary embodiment, a grip 24 may be disposed about at least a portion of the handle 22. The grip 24 may also be rotatably attached to the handle 22. This then allows a person to grab the grip 24 allowing the grip 24 to rotate relative the pair of skis 26 and evenly distribute the load.

In another exemplary embodiment, the inside or interior of the strap 12 may have a non-slip material 36 attached. The non-slip material 36 can be sewn, bonded or affixed to the inside of the strap 12 or integrally formed with the strap 12 as one fabric. The non-slip material 36 is used to help secure the pair of skis 26 as it prevents the skis 26 from sliding within the strap 12 while being carried or stored.

Figure 3:
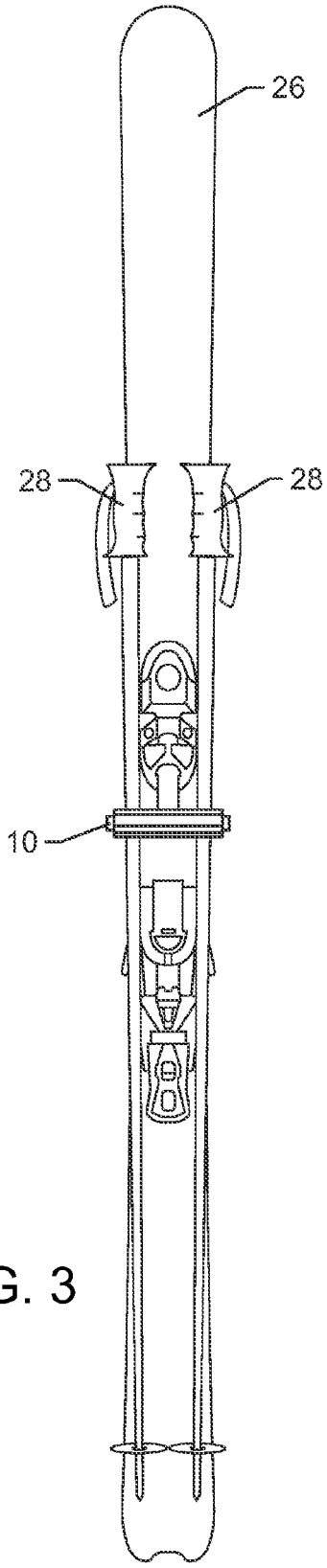
FIG. 3 is a top view of the exemplary embodiment of the ski carrier of FIGS. 1-2 now securing a pair of skis.
Figure 4:
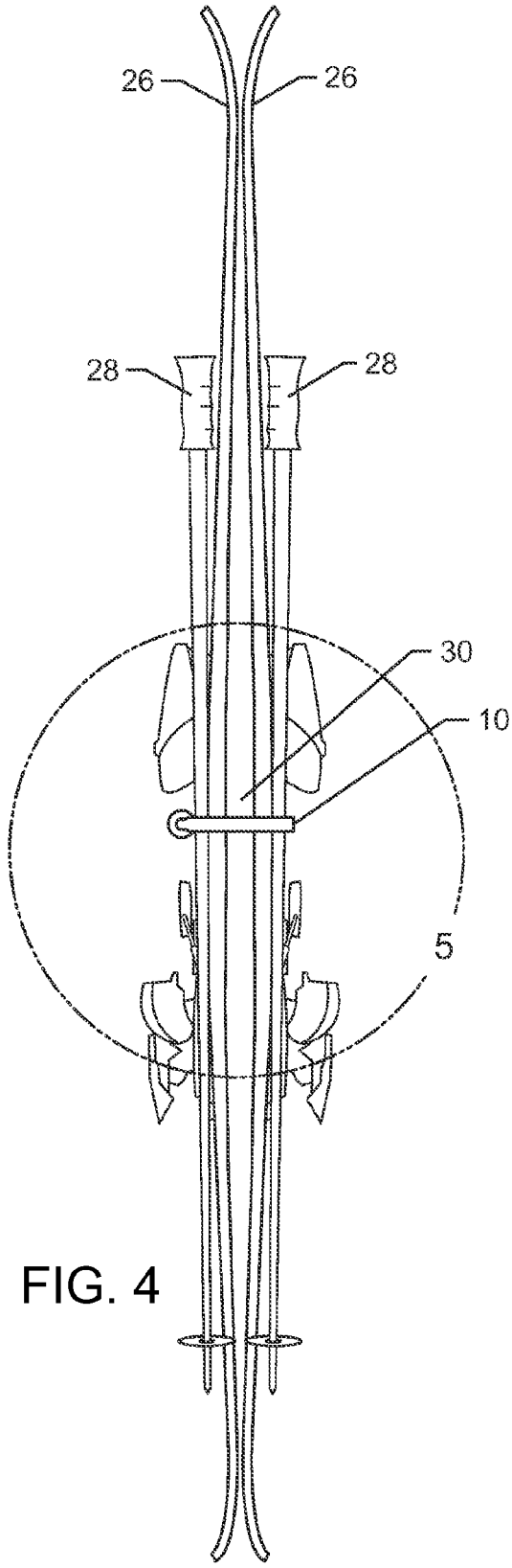
FIG. 4 is a side view of FIG. 3.

FIGS. 3 and 4 show the portable ski carrier 10 in operation. The pair of skis 26 and poles 28 are bound together by the ski carrier 10. Here, the skis 26 are placed such that each ski bottom is abutting the other. The poles 28 can then be placed on the outside of skis 26 both on one side as shown in FIG. 3, or on separate sides of the skis 26 as shown in FIG. 4. The strap 12 is wrapped around the skis 26 and poles 28, fed through the ring 14, pulled tight and secured with the hook-and-loop fastener 16 and 18. As shown in FIG. 4, two skis 26 abutting each other create a gap 30. When the strap 12 is tightened, it closes gap 30 to some extent and creates a preload that helps hold the ski carrier 10 in place. The preload is due to the natural flexibility and resiliency of the ski 26 itself.

Figure 5:
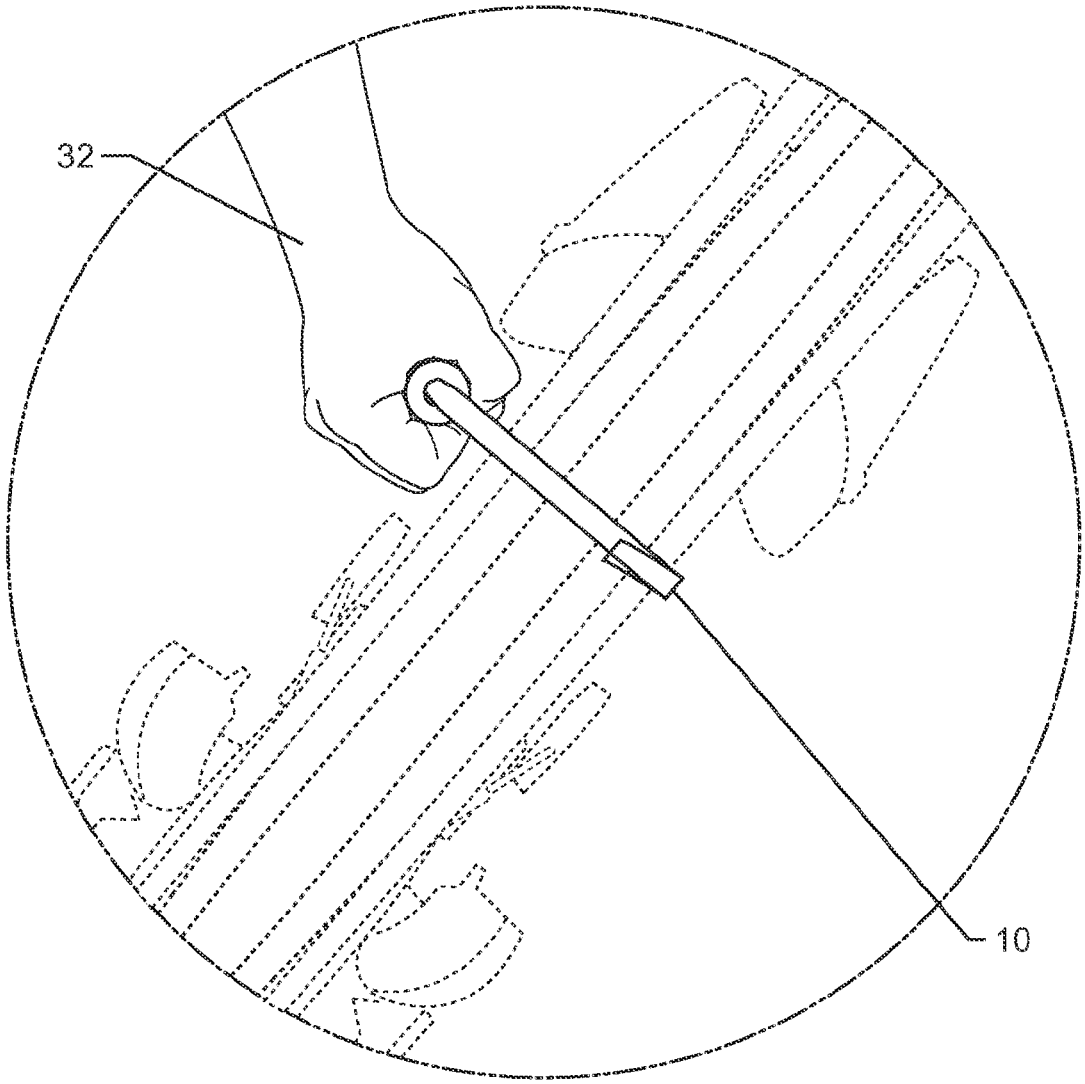
FIG. 5 is an enlarged view of FIG. 4 taken along line 5-5 now showing a user gripping the handle.

FIG. 5 is a close up of FIG. 4 along the line 5-5. This close up shows how a skier can then grab the ski carrier 10 with their hand 32. The handle 22 and grip 24 are sufficiently sized to leave enough room for the hand 32 and fingers to fit comfortably around. The ski carrier 10 should be placed substantially about the middle of the skis 26 such that it evenly balances the weight from one end to the other.

When the portable ski carrier 10 is not in use, it can be easily placed within the skier's pocket. This means that the ski carrier 10 can be carried while the skier is skiing, and then immediately used when the skier takes off his skis 26. The ski carrier 10 is substantially soft such that if a skier falls while skiing, the ski carrier 10 does not create a further risk of a localized bruise or injury.

Figure 6:
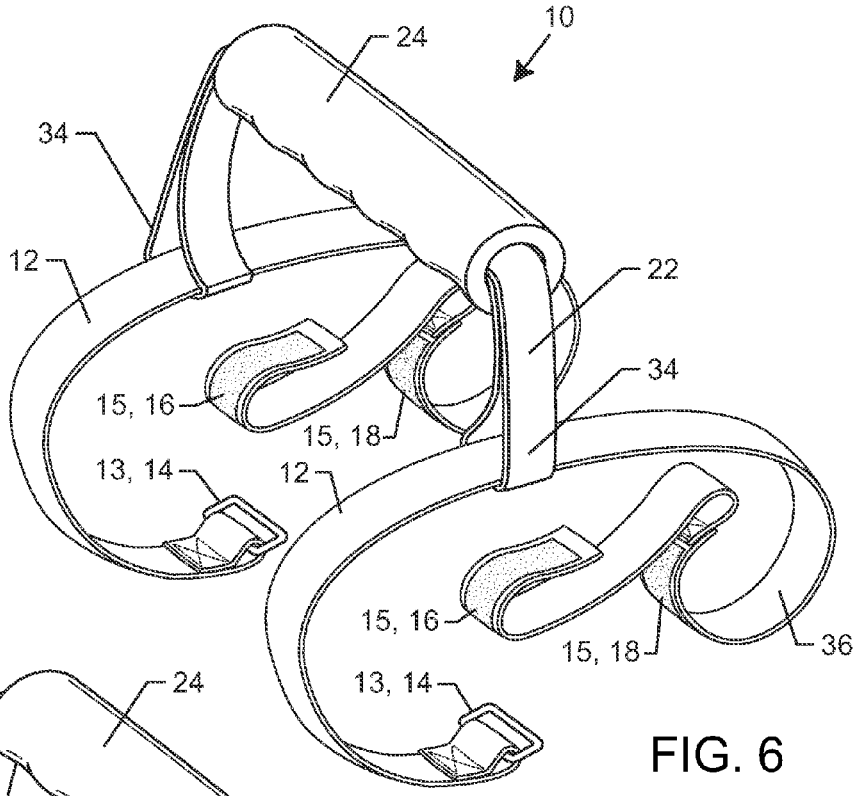
FIG. 6 is a perspective view of another exemplary embodiment of a ski carrier.

FIG. 6 is a perspective view of another exemplary embodiment of a portable ski carrier 10. In this embodiment, the ski carrier 10 has two straps 12 that are to be secured around the skis 26 and poles 28 a distance apart spanning the grip 24 and handle 22. As shown in FIG. 6, the handle 22 has two looped ends 34 that allow each strap 12 to be placed within. The straps 12 are free to move forward and back and rotate while remaining captured inside the looped ends 34. Allowing movement of the straps 12 can help facilitate their attachment around various skis 26 of different sizes while allowing the handle 22 and grip 24 to be properly positioned for comfortable carrying. However, it is to be understood by one skilled in the art that the handle 22 can be secured to each strap 12 in a multitude of ways such as by sewing or using clasps and various fasteners, and this disclosure is not be limited to the precise form described herein.

Figure 7:
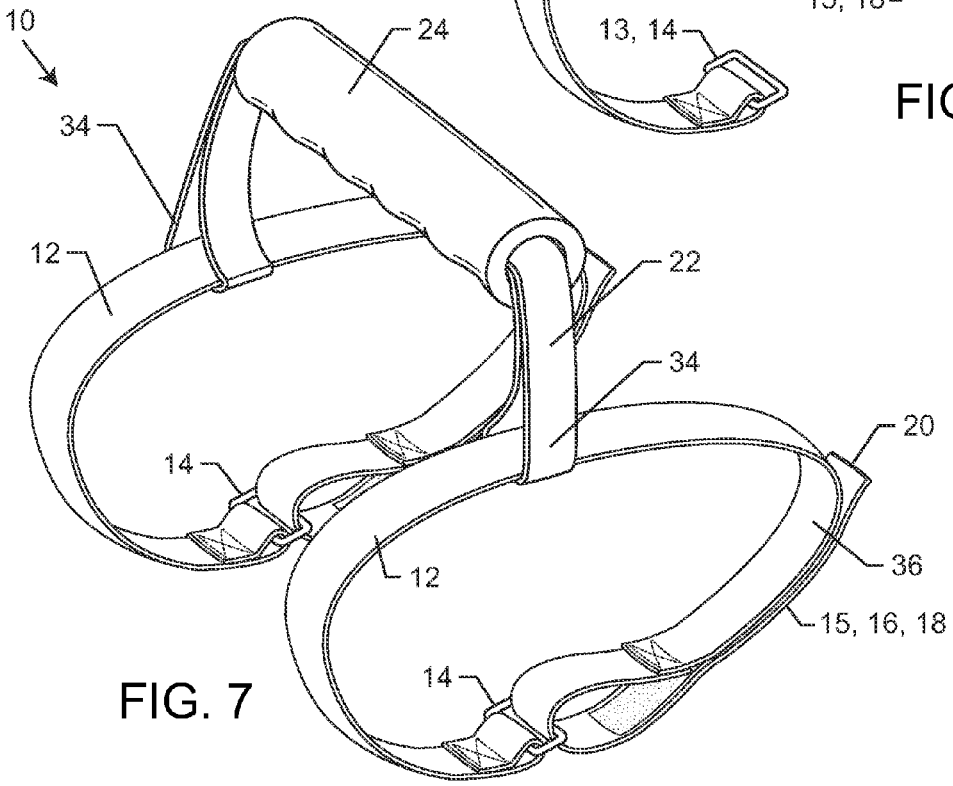
FIG. 7 is a perspective view similar to FIG. 6 wherein now the straps are fastened.

Each strap 12 has a strap receiver 13 and a strap fastener 15. The strap receiver 13 may comprise the rectangular shaped ring 14 at one end. The strap fastener 15 may comprise the hook-and-loop fastener with the hook side 16 and loop side 18 at the other end. As shown in FIG. 7, the strap 12 can be fed through the ring 14 and secured in position by fastening the hook-and-loop fastener 16, 18.

The handle 22 is attached to the straps 12 and is now aligned to the pair of skis 26. The portable ski carrier 10 is then able to be used to conveniently carry the pair of skis with one hand where now the handle 22 is disposed substantially perpendicular to the straps 12.

Figure 8:
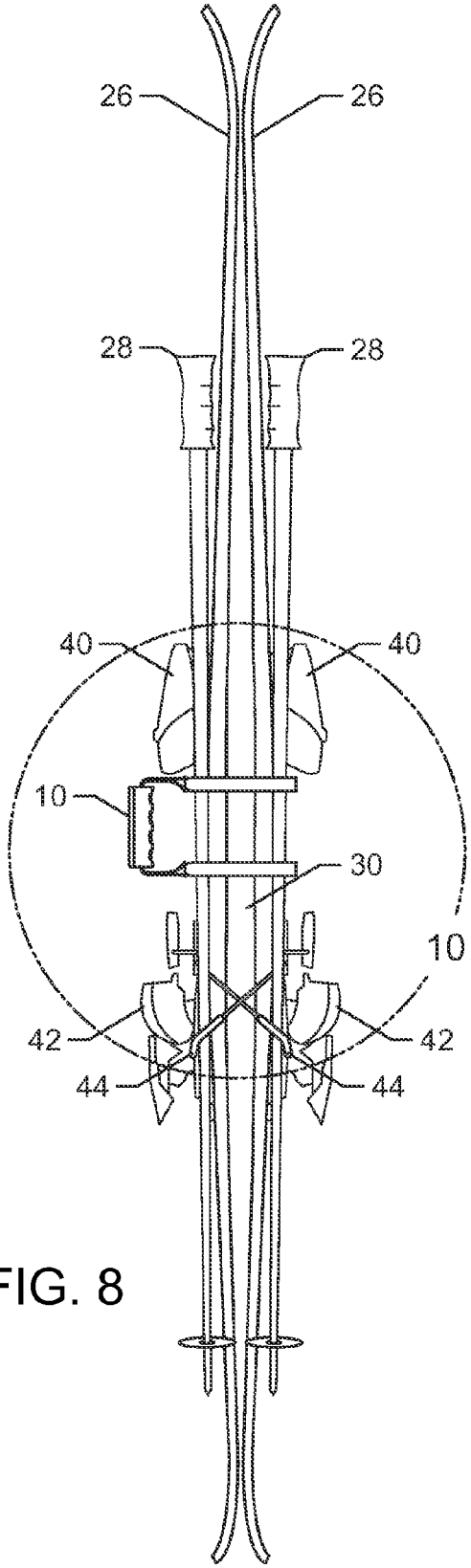
FIG. 8 is a side view of the exemplary embodiment of the ski carrier of FIGS. 6-7 now securing a pair of skis.
Figure 9:
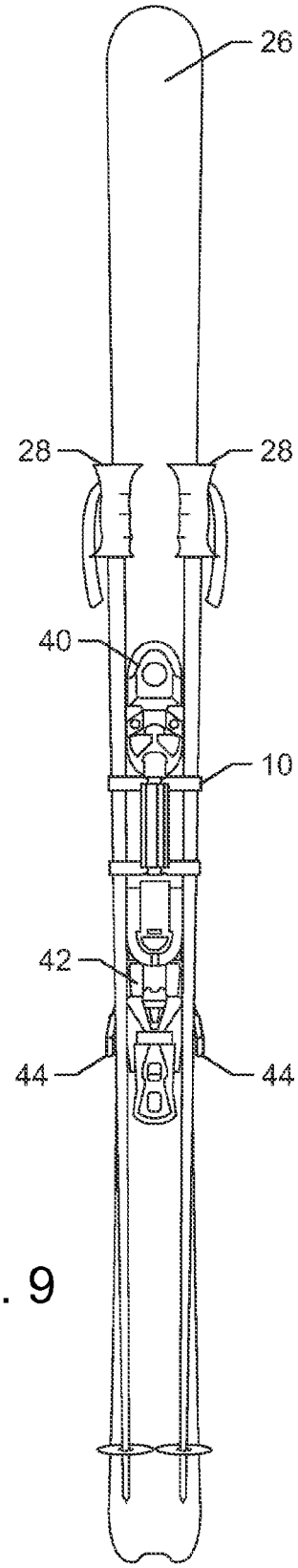
FIG. 9 is a top view of FIG. 8.

FIG. 8 is a side view of the ski carrier 10 now secured around a pair of skis 26 and poles 28. As shown in FIG. 8, the skis 26 are placed such that each ski bottom is abutting the other forming a gap 30 which helps to create a preload tension in the straps 12. The straps 12 are preferably disposed between the toe bindings 40 and the heel bindings 42 on each of the pair of skis 26. This configuration provides for greater balance and stability of the skis 26 and poles 28 in the carrier 10 compared to placing the straps 12 on either side of one of the bindings. This also minimizes the possibility of the skis sliding within the loops forms by the straps 12. The poles 28 can then be placed on the outside of each ski 26 and secured with the ski carrier 10. FIG. 9 is a top view similar to FIG. 8 now with two poles 28 secured on the each side of one ski 26 as opposed to both skis. Although not illustrated in this figure, a second ski 26 is placed with its bottom abutting the other ski to form a gap 30 as described above. It is up to the individual preference of each user on how to exactly secure the poles 28 relative to the skis 26 in the ski carrier 10—whether both poles 28 on the sides of one ski 26 or on one pole 28 on a side of separate skis 26. As illustrated in FIGS. 8 and 9, each of the poles 28 is preferably disposed between the heel binding 42 and a brake lever handle 44 from the opposite ski. Orienting the poles 28 in this way within both loops formed by the straps 12 and the brake lever handle 44 provides additional stability to the poles 28 while secured with the carrier 10.

Figure 10:
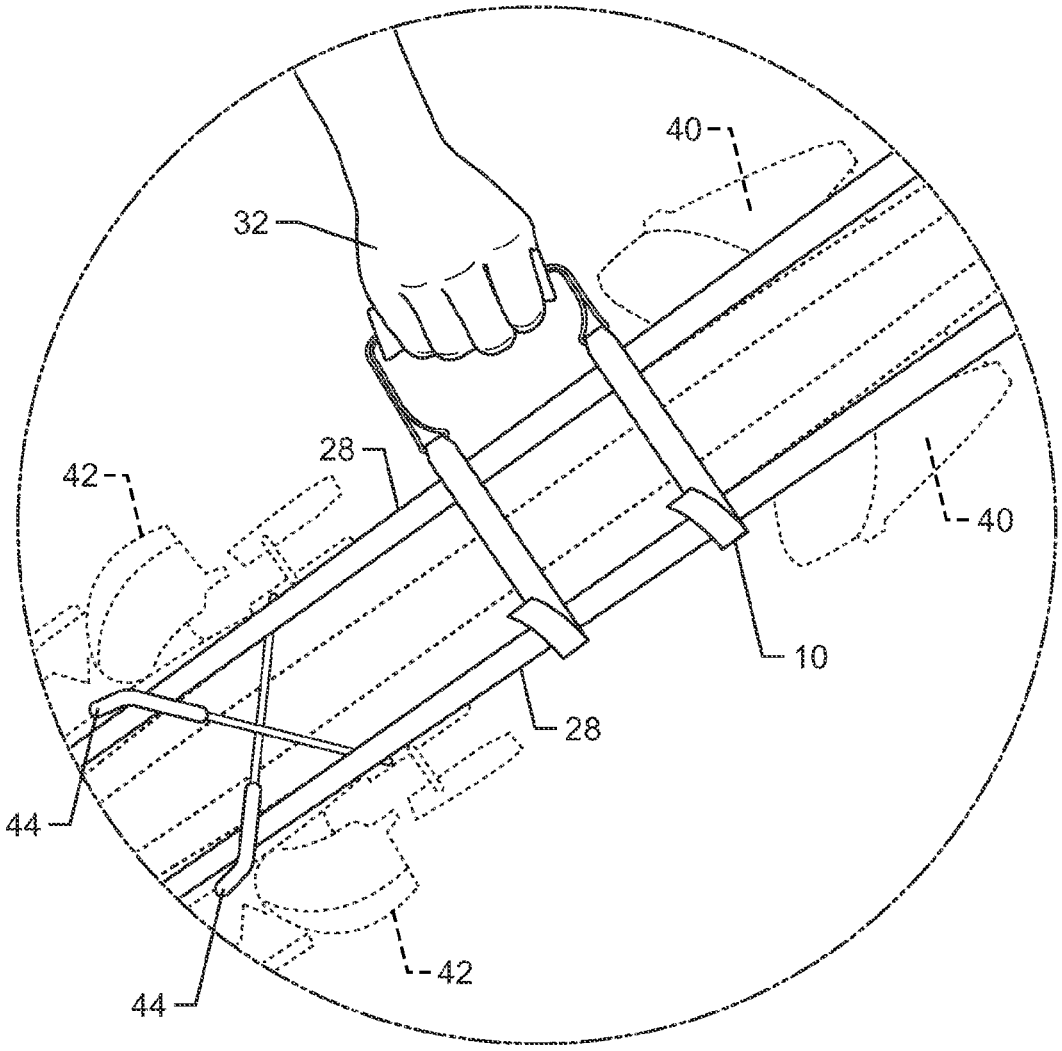
FIG. 10 is an enlarged view of FIG. 8 taken along line 10-10 now showing a user gripping the handle.

FIG. 10 is an enlarged view of FIG. 8 taken along line 10-10 now showing a hand 32 gripping the handle 22. As illustrated, the poles 28 as not only disposed within each loop formed by the straps 12, but also disposed between the heel binding 42 and the brake lever handle 44 from the opposite ski 26. When comparing FIG. 10 and FIG. 5, it can be seen that the embodiment of FIG. 10 naturally puts a user's hand 32 in a position rotated 90 degrees from FIG. 5. Again, it is up to the preference of the user whether to choose the embodiment of FIG. 5 as compared to the embodiment of FIG. 10.

Figure 11:
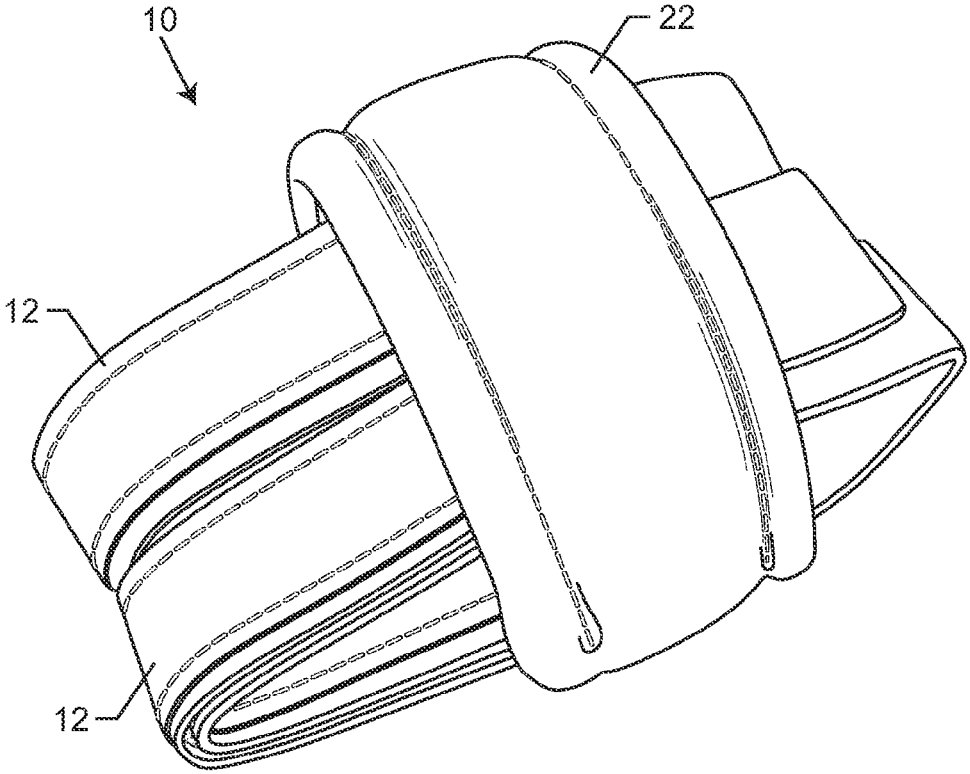
FIG. 11 is a perspective view of the ski carrier with the loops rolled under the handle.
Figure 12:
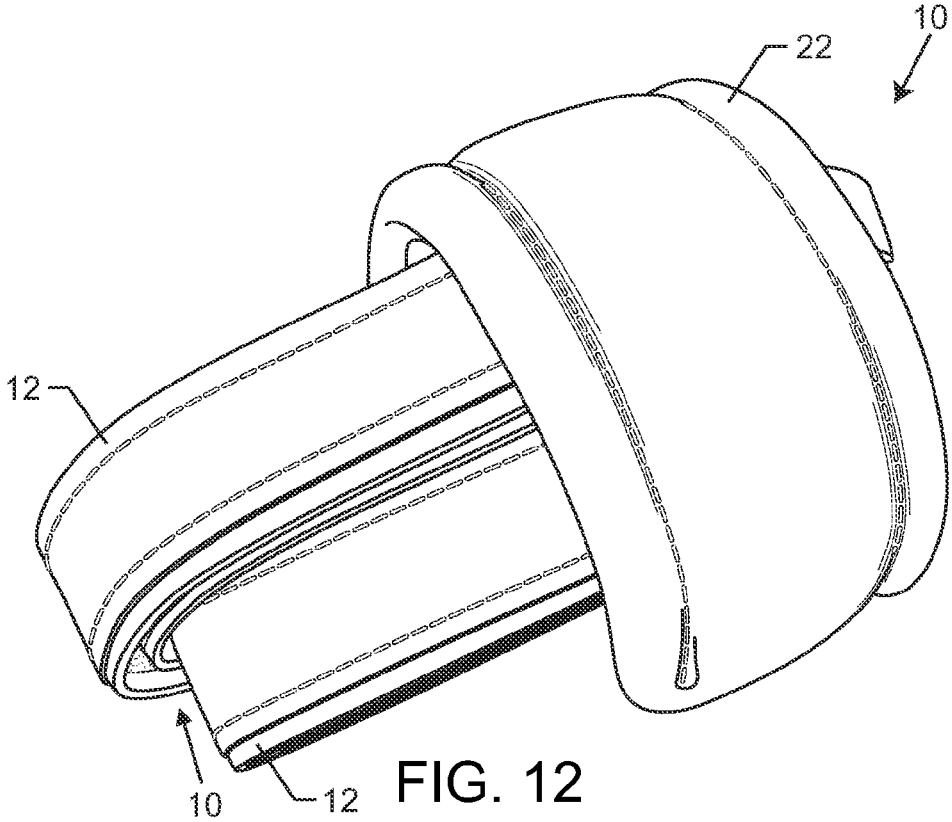
FIG. 12 is a perspective view of the ski carrier with the loops partially nested.
Figure 13:
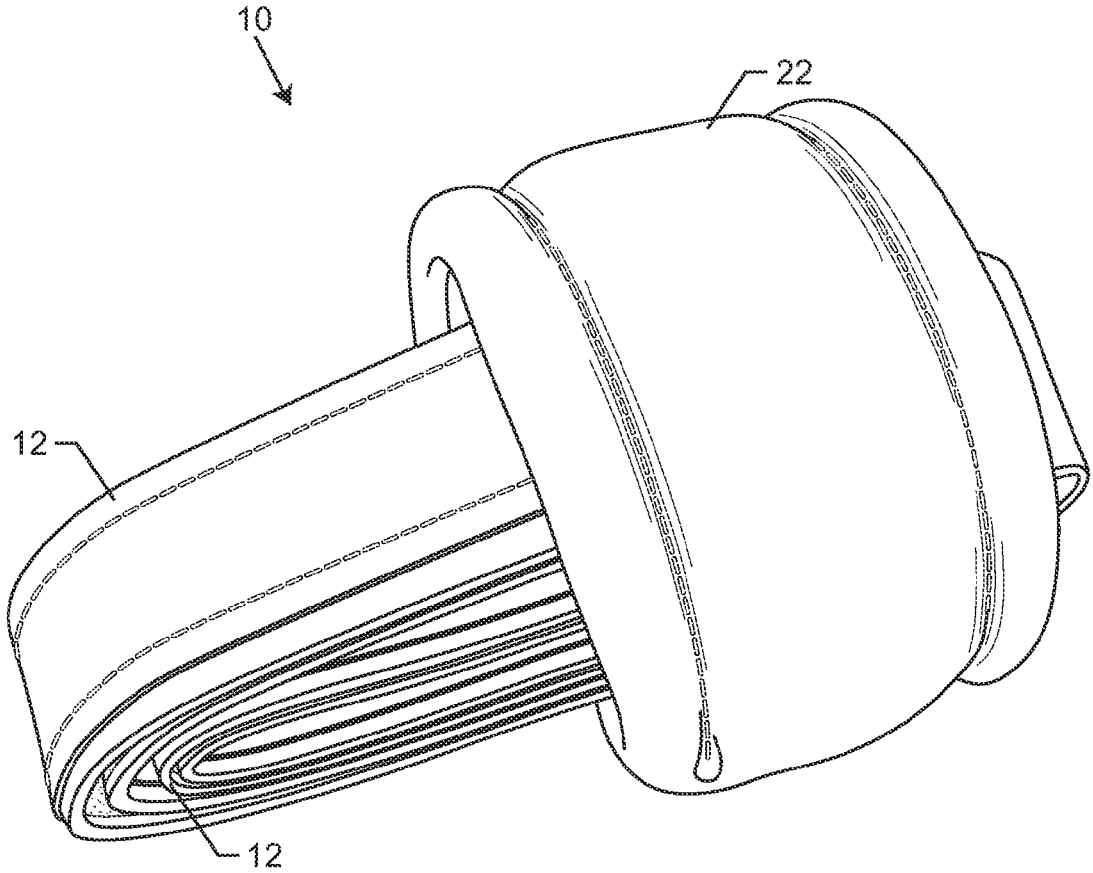
FIG. 13 is a perspective view of the ski carrier with the loops nested within one another underneath the handle.

In a particularly preferred embodiment, the ski carrier 10 may be compactly folded for easy storage on and off the slope. This folded configuration, illustrated in FIGS. 11-13, begins with the carrier 10 positioned as showing in FIG. 7, for example. The loops formed by each of the straps 12 are rolled inward underneath the handle 22. Once rolled under the handle 22, the loops formed by the straps 12 have been flipped upside down from how they are illustrated in FIG. 7. One of the looped straps 12 is then folded such that it is inserted or nested into the other of the looped straps 12 such that one looped strap 12 completely surrounds and encloses the other of the looped straps 12. Because of the initial rolling of the loops, the handle 22 fits snuggly around the nested straps 12.

Although several embodiments have been described in detail for purposes of illustration, various modifications may be made to each without departing from the scope and spirit of the invention. Accordingly, the invention is not to be limited, except as by the appended claims.

What is claimed is:

1. A portable ski and ski pole carrier system, comprising:

a pair of non-elastic, flexible straps each comprising a first end and a second end, wherein a strap receiver is disposed at the first end of each strap and a strap fastener is disposed at the second end of each strap, the strap receivers configured so as to receive the strap fasteners and form each of the pair of straps into a loop;

a pair of skis and ski poles secured within each loop formed by the pair of straps;

a non-slip material on an interior surface of each of the pair of straps when formed into a loop and configured so as to be disposed against the pair of skis and ski poles;

a handle attached to and disposed substantially perpendicular to each of the pair of straps and aligned to the pair of skis and ski poles secured in the loops; and wherein the pair of skis are disposed within the loops formed by each of the pair of straps, the ski poles disposed within the loops and adjacent to the pair of skis such that a portion of each ski pole is disposed between a heel binding on one of the pair of skis and a break lever handle extending from the other of the pair of skis.

2. The portable ski and ski pole carrier system of claim 1, wherein the handle is slidably coupled to the pair of flexible straps.

3. The portable ski and ski pole carrier system of claim 1, wherein the straps and the handle comprise a flexible fabric material.

4. The portable ski and ski pole carrier system of claim 1, including a grip disposed about at least a portion of the handle.

5. The portable ski and ski pole carrier system of claim 1, wherein the strap fasteners each comprise a hook-and-loop type fastener.

6. The portable ski and ski pole carrier system of claim 1, wherein the strap receivers each comprise a ring.

7. The portable ski and pole carrier system of claim 1, wherein the pair of skis are disposed with abutting bottom surfaces so as to form a resilient gap between a portion of the bottom surfaces.

8. The portable ski and pole carrier system of claim 7, wherein the loops formed by each of the pair of flexible straps are both configured to partially close the resilient gap so as to create a pre-load between the loops and the pair of skis.

9. The portable ski and pole carrier system of claim 1, wherein the loops formed by each of the pair of flexible straps are both disposed between toe bindings and heel bindings on the pair of skis.

10. A portable ski and ski pole carrier system, comprising:

a pair of non-elastic, flexible straps each comprising a first end and a second end, wherein a strap receiver is disposed at the first end of each strap and a strap fastener is disposed at the second end of each strap, the strap receivers configured so as to receive the strap fasteners and form each of the pair of straps into a loop;

a pair of skis and ski poles secured within each loop formed by the pair of straps;

a non-slip material on an interior surface of each of the pair of straps when formed into a loop and configured so as to be disposed against the pair of skis and ski poles;

a handle attached to and disposed substantially perpendicular to each of the pair of straps and aligned to the pair of skis and ski poles secured in the loops; and wherein the pair of skis are disposed with abutting bottom surfaces within the loops formed by each of the pair of straps, the loops disposed between toe bindings and heel bindings on the pair of skis, the ski poles disposed within the loops and adjacent to the pair of skis such that a portion of each ski pole is disposed between a heel binding on one of the pair of skis and a break lever handle extending from the other of the pair of skis.

11. The portable ski and ski pole carrier system of claim 10, wherein the handle is slidably coupled to the pair of flexible straps.

12. The portable ski and ski pole carrier system of claim 10, wherein the straps and the handle comprise a flexible fabric material.

13. The portable ski and ski pole carrier system of claim 10, including a grip disposed about at least a portion of the handle.

14. The portable ski and ski pole carrier system of claim 10, wherein the strap fasteners each comprise a hook-and-loop type fastener.

15. The portable ski and ski pole carrier system of claim 10, wherein the strap receivers each comprise a ring.

16. The portable ski and pole carrier system of claim 10, wherein the loops formed by each of the pair of flexible straps are both configured to partially close a resilient gap formed between the abutting bottom surfaces of the pair of skis so as to create a pre-load between the loops and the pair of skis.

* * * * *